US005147099A

United States Patent [19]

McLinden et al.

[11] Patent Number: 5,147,099

[45] Date of Patent: Sep. 15, 1992

[54] DRAWER OR CABINET LATCH

[75] Inventors: Thomas McLinden, Woodbury, Conn.; Ralph M. Nowak, Marblehead, Mass.

[73] Assignee: Kidie Products, Inc., Avon, Mass.

[21] Appl. No.: 768,824

[22] Filed: Sep. 30, 1991

[51] Int. Cl.[5] ..... E05C 1/10

[52] U.S. Cl. ..... 292/175; 292/152; 292/DIG. 38; 292/DIG. 65

[58] Field of Search ..... 292/175, 152, 153, DIG. 38, 292/DIG. 65; 312/333

[56] References Cited

U.S. PATENT DOCUMENTS

| | | | |
|---|---|---|---|
| 43,145 | 6/1864 | Warner | 292/152 |
| 537,746 | 4/1895 | Boyum . | |
| 608,353 | 8/1898 | Van Olst | 292/152 X |
| 2,280,084 | 4/1942 | Segal | 292/152 |
| 2,676,866 | 4/1954 | Woodin | 312/333 |
| 3,003,800 | 10/1961 | Hammond | 292/11 |
| 3,084,008 | 4/1963 | Mallett | 312/319 |
| 3,799,391 | 3/1974 | Brescia | 292/DIG. 38 X |
| 4,993,758 | 2/1991 | Schmutzler | 292/152 |

*Primary Examiner*—Richard E. Moore

*Attorney, Agent, or Firm*—Fish & Richardson

[57] ABSTRACT

A child-proof latch which prevents a child from directly accessing the latch member (arm) itself, thus rendering it extremely difficult for a child to open a cabinet secured by the latch. The latch of the invention comprises a latch member, a support for the latch member, and an actuator member for selectively moving the latch member between its extended position (in which the cabinet is prevented from opening) and retracted position (in which the cabinet is allowed to open). Mutually engageable locking surfaces are provided on the actuator and the support, such that the actuation is normally locked with the latch member in its normally extended position. In order to open the cabinet, it is necessary to first disengage the locking surfaces and then depress the actuator sufficiently to move the latch, which is biased toward its extended position, to its retracted position. As it is unlikely that a child could accomplish both tasks, the latch is extremely secure.

12 Claims, 3 Drawing Sheets

DRAWER OR CABINET LATCH

BACKGROUND OF THE INVENTION

The present invention relates to latches for drawers, cabinets and the like, (referred to hereinafter as "drawers" for simplicity), and more particularly to such latches that are intended to be child-proof.

Many items present in the home pose a serious danger to children, who are unaware of their potentially harmful effects. Such items include chemicals used in the household, e.g. cleaning products, medicines, adhesives and solvents; and dangerous objects, e.g. knives and other kitchen utensils, razor blades, and various tools.

To prevent children from accessing these items, it is well known to equip the drawers or cabinets containing them with "child-proof" latches which are intended to be difficult or impossible for a child to operate. A latch of this type is conventionally installed on the inside surface of a drawer panel, e.g. the front panel of a drawer or a cabinet door. The latch allows the closure panel to be opened to a limited extent only, after which it is necessary to reach over the top of the panel and release the latch. In one type of latch, the latch is released by depressing a resilient arm to disengage the latch mounted on the end of the arm from an interlocking member mounted on the cabinet frame. In another type of latch, such as Product No. 3313, Heavy Duty Cabinet/Drawer Latch, sold by Kiddie Products, Inc., d/b/a The First Years, Avon, Massachusetts, attempts have been made to make it difficult for the child to release the arm by spring biasing the latch such that a substantial force is required to release it.

The problem remains, however, that as long as a child is able to access the latch, the child will potentially have the strength to release it. Thus, it would be advantageous to provide a child-proof latch which would be more difficult for a child to access and release by requiring a second actuating motion.

SUMMARY OF THE INVENTION

The present invention provides a child-proof latch which prevents a child from directly accessing the latch member (arm) itself, thus rendering it extremely difficult for a child to open a cabinet secured by the latch. The latch of the invention comprises a latch member, a support for the latch member, and a separate member for selectively moving the latch member from its extended position (in which the cabinet is prevented from opening) to its retracted position (in which the cabinet is allowed to open). Mutually engageable locking surfaces are provided on the actuator and the support, such that the actuator is normally locked in its extended position. In order to manually move the latch member to its retracted position, it is necessary first to transversely disengage the locking surfaces, a task which would be difficult for a small child. After disengaging the locking surfaces, it is still necessary to depress the actuator sufficiently to move the latch, which is biased toward its extended position, to its retracted position in order to open the cabinet. Accordingly, it is exceedingly difficult for a small child to accomplish both tasks.

In one embodiment of the invention, the child-proof latch comprises a support member having a base, adapted for mounting on the inside surface of an openable drawer or cabinet door, and a latch support; a latch member slidably mounted to said latch support for reciprocal movement in a plane normal to said inside surface between extended and retracted positions relative to said latch support, said latch member comprising a latch surface on the side of said latch member facing said extended position, said latch surface spaced from and facing toward said base, and a cam surface extending from said latch surface away from said base and sloping from said latch surface in the direction of said retracted position; biasing means connected between said support member and said latch member normally biasing said latch member toward said extended position; and a separate actuator member slidably mounted to said latch support for selectively moving said latch member from said extended position to its retracted position, the latch member separate from and moveable independently of the actuator, said actuator extending over and engaging said latch member on a portion thereof facing said extended position; and mutually engageable locking surfaces on said actuator and said support member extending transversely of said plane and normally engaged with said latch member in said extended position and selectively disengageable by transverse movement of said actuator for moving said latch member to said retracted position be movement of the actuator in said plane.

In a preferred embodiment, the actuator member is of resilient material, and the locking surfaces are thus resiliently biased to an engaged position, locking the actuator in the extended position. It is also preferred that the latch member be spring-biased in toward its extended position.

DETAILED DESCRIPTION OF THE INVENTION

Figure 1:
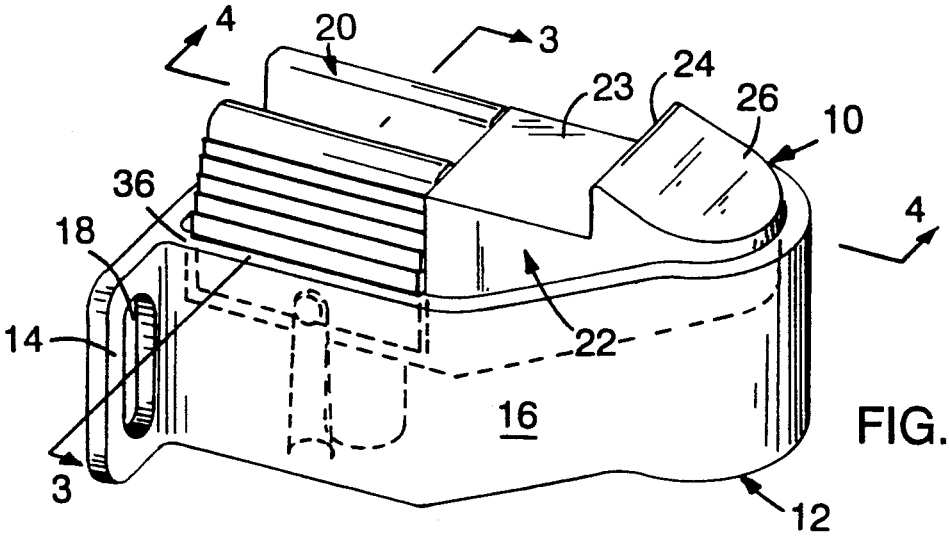
FIG. 1 is an isometric view of a latch according to one embodiment of the invention.

FIG. 1 illustrates a preferred embodiment of the latch of the invention. Latch 10 comprises support member 12, which comprises latch support 16 and base 14. Base 14 is adapted for mounting on the inside surface of an openable drawer or cabinet door by the provision of elongated apertures 18. The latch of the invention may be mounted using any conventional attachment means, and the apertures in the base may be of any shape or configuration. The latch may, optionally, have a solid base, without apertures, and be mounted by other means, such as a clip, adhesive or bracket. The configuration shown in FIG. 1 is preferred, as it allows the latch to be easily mounted by screws (not shown), and its position easily adjusted. Latch 10 further comprises separate latch member 22, comprising latch surface 24 and cam surface 26, slidably mounted to the latch support for reciprocal movement, in a plane normal to the base, between extended and retracted positions relative to the latch support, comprising latch surface 24 spaced from and facing toward the base, and cam surface 26, extending from the latch surface away from the base and sloping from the latch surface in the direction of the retracted position; and a separate actuator member 20, slidably mounted to the latch support for selectively moving the latch member between its extended and retracted positions. As shown, the actuator extends over and engages the latch member on the side thereof which faces the extended position.

In use, when closing a drawer cam surface 26 engages the upper edge of the drawer frame during closure of the drawer, latch member 22 independently deflects downward, towards its retracted position, until cam surface 26 clears the frame, and then returns to its extended position, in which latch surface 24 contacts the inside edge of the frame, preventing the drawer from opening.

Figure 4:
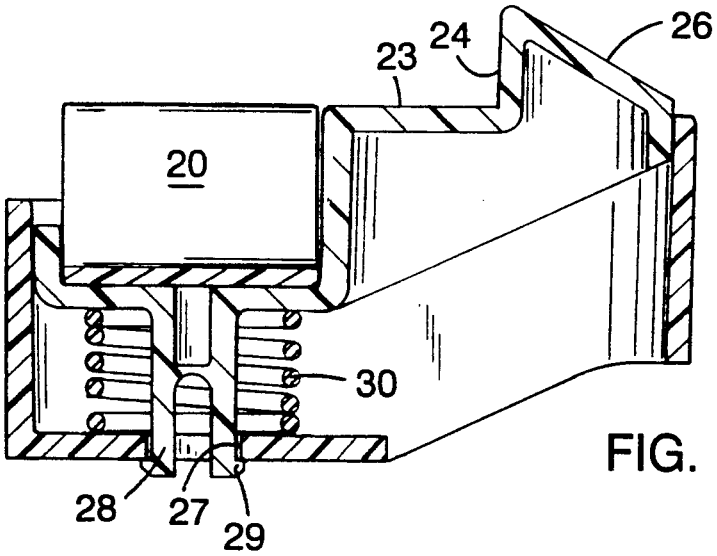
FIG. 4 is a cross-sectional view, taken along the line 4—4 in FIG. 1.
Figure 3A:
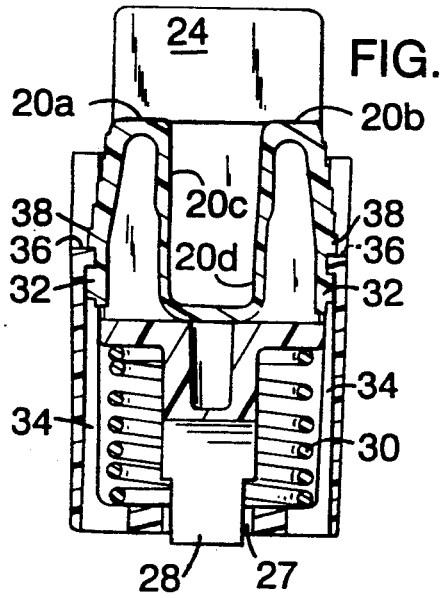
FIGS. 3*a* and 3*b* are cross-sectional views, taken along the line 3—3 in FIG. 1, showing the latch in its extended and retracted positions, respectively.
Figure 3B:
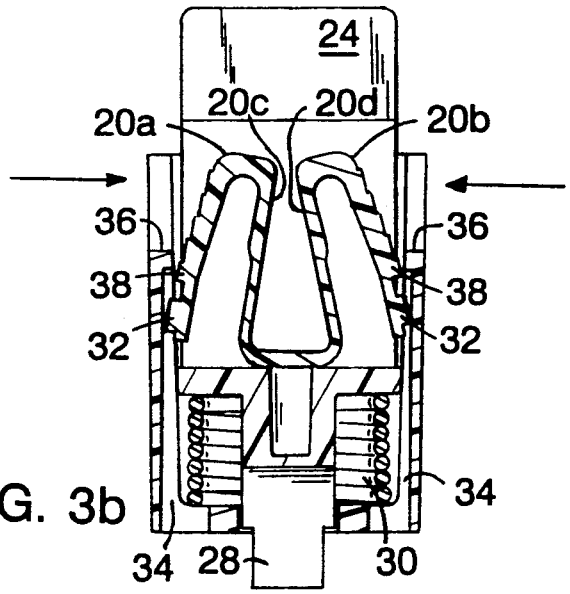
Figure 2:
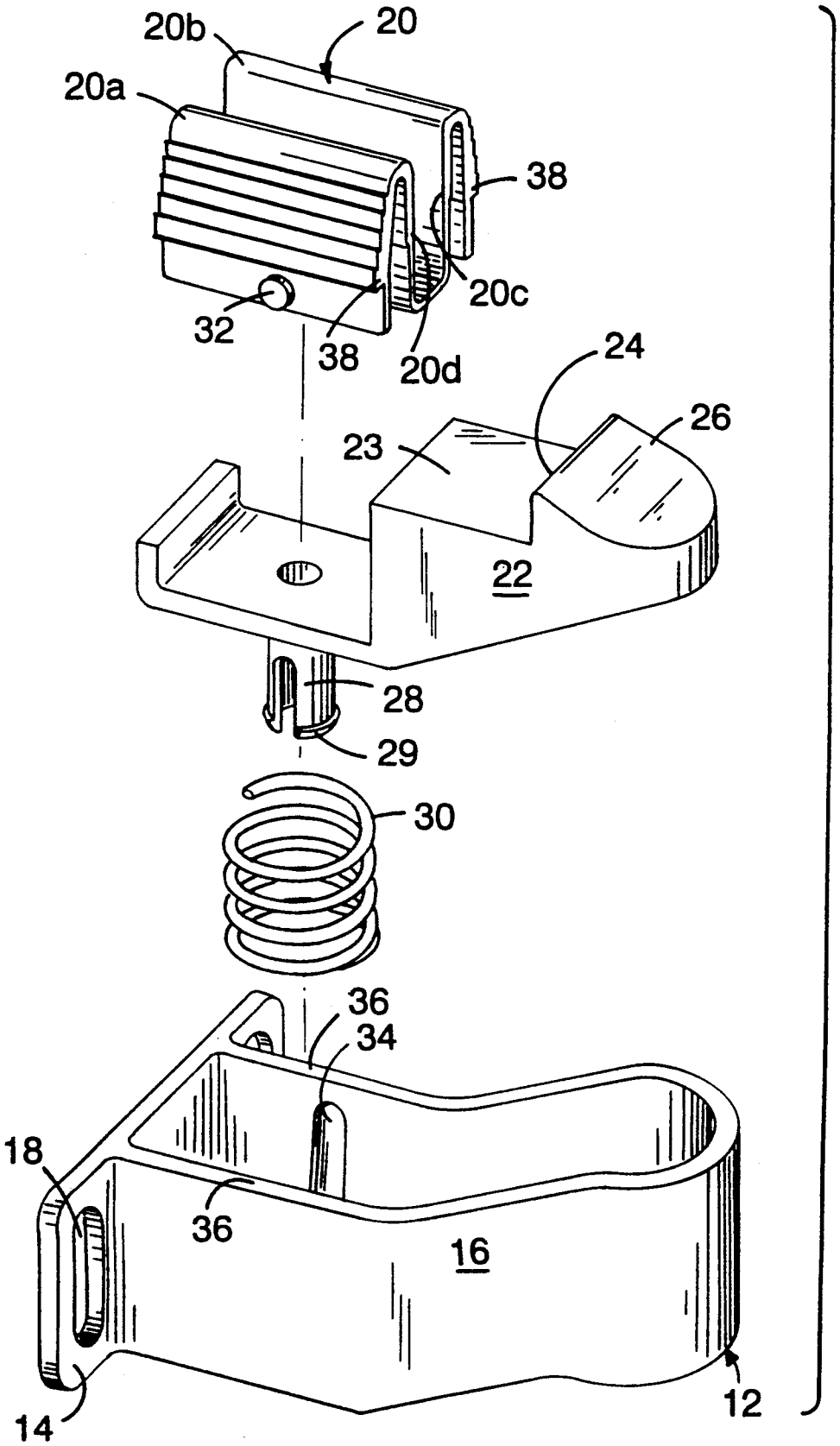
FIG. 2 is an exploded view of the latch shown in FIG. 1.

As seen in FIG. 2, an exploded view of latch 10, and also in FIGS. 3*a*, 3*b* and 4, latch member 22 is preferably spring-biased by disposing annular stake 28, which extends from the lower surface of latch member 22, through spring 30. Stake 28 is inserted through aperture 27 in latch support 16 and is retained by lip 29, which extends beyond and engages the lowermost surface of latch support 16. Stake 28 is split so that it can resiliently bend inward during insertion through aperture 27 and expand after insertion to prevent removal. Other, similar means for spring-biasing the latch member could be used, such that a biasing member is disposed between the latch member and latch support, maintaining them in opposed spaced relation. Other biasing means could also be utilized if desired, such as a resilient portion of the latch support or the latch member engaging the other member.

As shown in FIG. 2, in the preferred embodiment actuator member 20 has an M-shaped cross-section, overlying a portion of latch member 22 and spring 30. As illustrated in FIGS. 2, 3*a* and 3*b*, actuator member 20 has two protrusions on each of its side exterior surfaces, ridge 38 and boss 32. When the latch is in its extended, normal position, actuator ridge 38 extends over a portion of surface 36 of latch support 16, lockingly engaging an oppositely facing latch support locking surface 36 such that the actuator may not be pressed downward to operate the latch. Boss 32 engages, and is slidably retained by, channel 34, which is closed at its end adjacent the actuator in the extended position of the latch member, preventing actuator member 20 from being removed from latch support 16 and allowing for smooth movement of the actuator between the extended and retracted positions.

In order to move actuator member 20 into latch support 16, i.e. to move the latch into its retracted position, it is necessary to deflect the two U-shaped portions 20*a* and 20*b* of actuator member 20, transversely of the plane of movement of the latch member, towards each other. (See arrows in FIG. 3*b*). As the U-shaped portions are deflected inward, bosses 32 are retained in channel 34 as the actuator moves latch member 22 against spring 30. To facilitate the inward deflection of the U-shaped portions, it is preferred that the actuator member be of a resilient material, and that areas 20*c* and 20*d* of U-shaped portions 20*a* and 20*b* either have a reduced cross-section relative to the rest of the U-shaped portion, or are formed of a more flexible material. (The embodiment in which the crosssection is reduced is shown in FIGS. 3*a* and 3*b*).

When the U-shaped portions are transversely deflected inwards, ridge 38 is allowed to slip over surface 36, and boss 32 slides freely downward in channel 34. As the actuator member moves downward in this manner, it depresses the latch member, thus allowing the cabinet door to open. When downward pressure is released, the spring 30 causes the latch member and actuator member to return to the extended position and to latch in the extended position as ridges 38 resiliently move outwardly to overlie surface 36 of support 16.

A cross-sectional view of latch 10, taken along line 4—4, is shown in FIG. 4. This view illustrates the locking engagement of stake 28 after its insertion through aperture 27, as described hereinabove with reference to FIG. 2.

While it is preferred that the actuator member have a configuration similar to that shown, any shape may be used, provided the actuator member is in engagement with the latch support when the latch member is in extended position, and may be disengaged from the latch support in order to move the latch member into retracted position.

Appropriate materials for use in the latch of the invention will be readily apparent to those skilled in the art. It is preferred that the spring 30 have a spring force of a magnitude which will allow an adult to depress the latch member with relative ease, while preventing a child from doing so. It is also preferred that the actuator member be of a resilient material, as described above, and that the latch member, latch support and base be of a plastic or the like, for ease and economy of manufacture. In a preferred embodiment of the invention, the actuator, latch member, latch support and base are formed of plastic, such as ABS in the disclosed embodiment.

The dimensions of the latch of the invention may vary depending upon the desired use. However, it is preferred that the actuator member be of sufficient length to allow an adult to easily reach into the drawer and operate it, but not so long as to allow the child to reach into the drawer and access its contents. Preferred lengths for this component are thus from about 1 to about 4 inches. It is also preferred that the length of flat surface 23, shown in FIG. 1, correspond approximately to the thickness of the drawer frame or other surface on the drawer or cabinet with which it engages. If the flat surface is substantially longer that the thickness of the drawer frame, and thus extends into the opening when the drawer is partially open and is being prevented from further opening by the latch, it is possible that a child could reach into the opening and bypass the actuator by depressing the latch member directly. Standard drawer frames are typically about 0.75 inches thick, and thus the preferred length of flat surface 23 is about 0.75 inches.

Figure 5A:
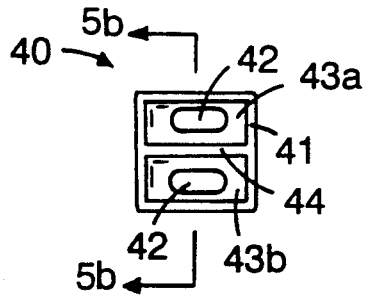
FIGS. 5 *a* and 5*b* are, respectively, top and crosssectional views of a catch which may be used in conjuction with a latch of the invention.
Figure 5B:
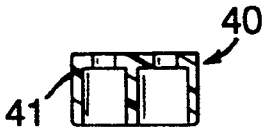
Figure 6A:
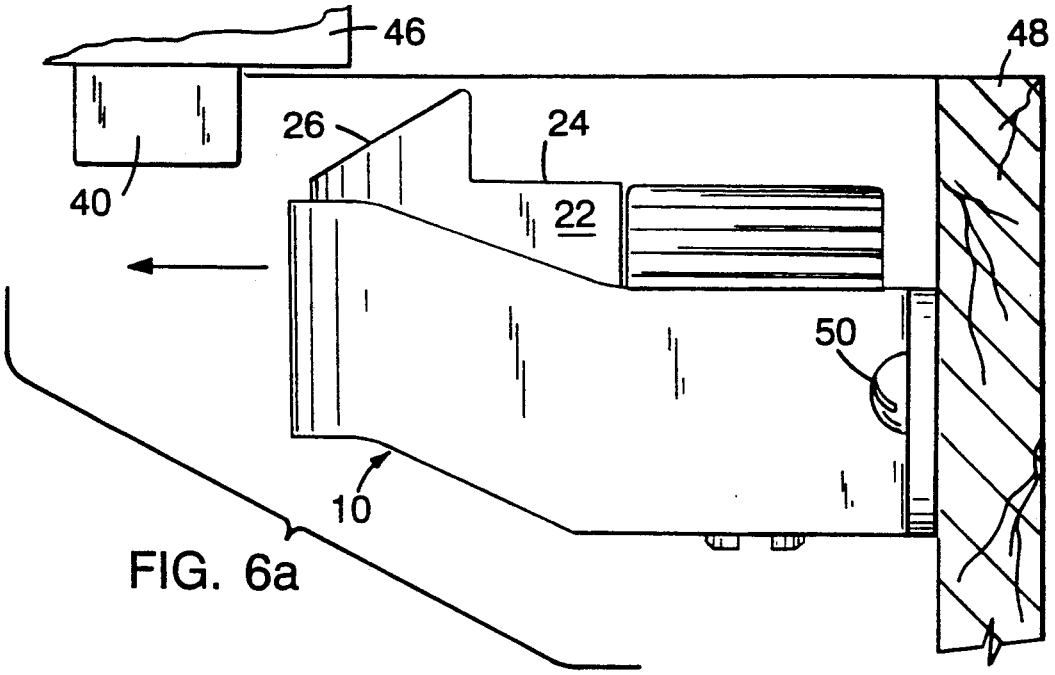
FIGS. 6*a* and 6*b* are side views of a latch of the invention secured to a closure panel, according to an embodiment of the invention in which a corresponding catch is provided on the drawer frame.
Figure 6B:
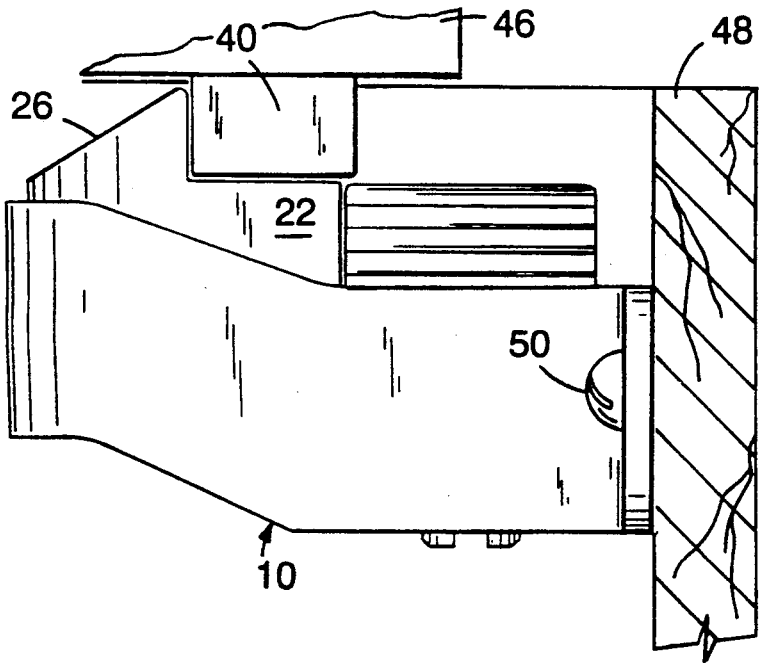

FIGS. 5*a* and 5*b* illustrate an optional catch which may be used in conjunction with a latch of the invention. It is particularly advantageous to provide such a catch when the latch is to be used with drawers or cabinet doors which do not have a protruding surface (e.g. a drawer frame) for the latch to engage. Catch 40, as shown in FIGS. 5*a* and 5*b*, preferably comprises an approximately rectangular frame 41 with a center wall 44 disposed lengthwise across said frame and defining two regions 43*a* and 43*b*, having approximately equal areas; and apertures 42, by which the catch can be secured to the drawer or cabinet frame by screw or other conventional means. As shown in FIG. 6*a*, catch 40 is mounted on drawer or cabinet frame 46 in a location such that it will be engaged by latch 10, which is attached to closure panel 48 by screws 50. As shown in FIG. 6*b*, catch 40 functions in the same manner as a drawer frame, i.e. cam surface 26 engages the upper edge of the drawer frame during closure of the drawer, latch member 22 independently deflects downward, towards its retracted position, until cam surface 26 clears the catch, and then returns to its extended position, in which latch surface 24 contacts the catch, preventing the door from opening. Center wall 44 of the catch has a height equal to the wall of the frame 41, is aligned with the direction of movement of latch 10, allows the latch member to move smoothly over the catch, and prevents the latch from becoming caught in frame 41. Catch 40, like a drawer frame, extends over flat surface 23 when the drawer is partially open, preventing direct access to the latch member. The described catch configuration is preferred, but other configurations could be employed, e.g. a solid rectangular catch which could be adhered to the drawer or cabinet frame. It is important however, to prevent direct access to the latch member, that the lower surface of the catch be contoured such that the catch substantially covers and renders inaccessible the flat surface when the latch is in its extended position, i.e. so that flat surface 23 is not exposed when the drawer is partially open.

The above figures and description illustrate preferred embodiments of the invention. Other variations and modifications will occur to those skilled in the art which are within the scope of the invention.

What is claimed is:

1. A drawer or cabinet door latch comprising:

a support member having a base, adapted for mounting on the inside surface of an openable drawer or cabinet door, and having a latch support;

a latch member slidably mounted to said latch support for reciprocal movement in a plane normal to said base between extended and retracted positions relative to said latch support, said latch member comprising a latch surface on the side of said latch member facing said extended position, said latch surface spaced from and facing toward said base, and a cam surface extending from said latch surface away from said base and sloping from said latch surface in the direction of said retracted position;

a biasing member connected between said support member and said latch member normally biasing said latch member toward said extended position; and a separate actuator member slidably mounted to said latch support for selectively moving said latch member from said extended position to its retracted position, said actuator extending over and normally engaging said latch member on a portion thereof facing said extended position, said latch member separate from and moveable between said extended and retracted positions independently of said actuator; and mutually engageable locking surfaces on said actuator and said support member extending transversely of said plane and normally engaged, said locking surfaces selectively disengageable by movement of said actuator transversely of said plane for movement of said latch member to said retracted position by movement of said actuator in said plane.

2. The latch of claim 1 in which said actuator is of resilient material and said locking surfaces are resiliently biased thereby to an engaged position with said latch member in said extended position.

3. The latch of claim 2 wherein said locking surfaces comprise at least one ridge on the outer side surface of one portion of said actuator which lockingly surface in the extended position, and said one portion is resiliently moveable transversely of said plane for selective disengagement of said ridge from said latch support.

4. The latch of claim 3 wherein the actuator is generally M-shaped, and comprises two connected, inverted generally U-shaped portions resiliently moveable toward each other.

5. The latch of claim 4 wherein the actuator comprises a said ridge on each inverted U-shaped portion, said ridges each lockingly engaging an oppositely facing latch support locking surface in the extended position, and said portions when deflected towards each other disengage the latch support such that the latch member may move to the retracted position.

6. The latch of claim 5 wherein said portions are in opposed spaced relation and the inward-facing areas of said portions have a reduced cross-section at their lower extremities.

7. The latch of any one of claims 1–6 wherein the actuator member comprises a boss disposed on said actuator which is slidably retained in a channel in said latch support, said channel closed at its end adjacent said actuator in the extended position of said latch member.

8. The latch of claim 1 wherein the biasing member comprises a spring retained between said latch member and said latch support normally biasing said latch member and said latch support in opposed spaced relation.

9. A latch of claim 1 wherein said latch member comprises a flat surface extending from said latch surface toward said actuator, said flat surface having a length approximately equal to the predetermined thickness of a frame with which the latch is intended to be used.

10. A latch of claim 9 wherein said flat surface has a length of approximately 0.75 inches.

11. A latch of claim 1 in combination with a catch wherein said latch member comprises a flat surface extending from said latch surface toward said actuator, and said latch engages said catch, said catch having a surface facing said latch which is contoured such that said catch substantially covers and renders inaccessible said flat surface when said latch is in its extended position.

12. A drawer or cabinet door latch comprising:

a support member having a base, adapted for mounting on the inside surface of an openable drawer or cabinet door, and a latch support, said latch support having an aperture in its lowermost surface;

a latch member slidably mounted to said latch support for reciprocal movement in a plane normal to said base between extended and retracted positions relative to said latch support, said latch member comprising a latch surface on the side of said latch member facing said extended position, said latch surface spaced from and facing toward said base, a cam surface extending from said latch surface away from said base and sloping from said latch surface in the direction of said retracted position, and a stake disposed on a lower surface of said latch member which extends through said aperture, and said stake having a lip on its distal end engaging said latch support about said aperture for retaining said stake in said aperture;

a spring connected between said support member and said latch member about said stake normally biasing said latch member toward said extended position; and a separate generally M-shaped actuator member, comprising two connected, inverted generally U-shaped portions resiliently biased outwardly and slidably mounted to said latch support for selectively moving said latch member from said extended position to is retracted position, said actuator extending over and normally engaging said latch member on the side thereof facing said extended position, said latch member separate from and moveable between said extended and retracted positions independently of said actuator; a boss disposed on said actuator which is slidably retained in a channel in said latch support, said channel closed at its end adjacent said actuator in the extended position of said latch member; and a ridge disposed on the side of each said U-shaped portion extending transversely of said plane and normally overlying said latch support when said latch is in its extended position, and portions moveable transversely of said plane towards each other for disengagement of said ridges and said latch support to permit movement of the latch member to the retracted position by movement of said actuator in said plane.

* * * * *